United States Patent [19]

Kurz

[11] Patent Number: 4,901,441

[45] Date of Patent: Feb. 20, 1990

[54] CAN OPENER

[75] Inventor: Reinhard Kurz, Nidderau, Fed. Rep. of Germany

[73] Assignee: Braun Aktiengesellschaft, Kronberg, Fed. Rep. of Germany

[21] Appl. No.: 158,860

[22] Filed: Feb. 22, 1988

[30] Foreign Application Priority Data

Feb. 27, 1987 [DE] Fed. Rep. of Germany ..... 3706414
Apr. 1, 1987 [DE] Fed. Rep. of Germany ..... 3710884

[51] Int. Cl.[4] ..... B67B 7/46
[52] U.S. Cl. ..... 30/401; 30/421
[58] Field of Search ..... 30/420, 421, 416, 423, 30/424, 425, 426, DIG. 1, 401

[56] References Cited

U.S. PATENT DOCUMENTS 2,975,515 3/1961 Land ..... 30/420
4,622,749 11/1986 Inagaki ..... 30/421

*Primary Examiner*—Douglas D. Watts

*Attorney, Agent, or Firm*—Fish & Richardson

[57] ABSTRACT

The invention discloses a can opener having a driving wheel (4) which is adapted to be driven by a drive unit, is rotatably mounted on a housing (1) and which, for the purpose of propelling a can (24), engages from outside under the seam (6) at the point of engagement (29). Above the lid (10), a cutter (3) is mounted on the housing on a pivot shaft (13) at a predetermined distance from the driving wheel (4), the cutter being movable from an initial position (20) into a cutting position (28) and having a piercing tip (17) and an adjoining cutting edge (8) with a cutting area (9) which is in engagement with the lid (10) when in the cutting position (28). To guide the can (24), a first abutment stop (7) is provided on the housing (1), being secured to the can opener rearwardly of the point of engagement (29) when viewed in the direction of movement (12) of the can (24). Provided on the cutter (3) is a second abutment stop (15) which acts upon the seam (6) from above when the can opener is in the cutting position (28).

28 Claims, 3 Drawing Sheets

CAN OPENER

This invention relates to a can opener for severing the lid from a can, including a preferably electrically operated drive unit and a driving wheel which is adapted to be driven by the drive unit, is rotatably mounted on a housing and, for the purpose of propelling the can, engages from outside under the seam of the can at the point of engagement, and including a cutter which is mounted on a pivot shaft at a predetermined distance from the driving wheel on the housing and is pivotable from an initial position into a cutting position, the cutter having a piercing tip and an adjoining cutting edge with a cutting area which is in engagement with the lid when in the cutting position with a first abutment stop for guiding the can relative to the cutting edge being provided on the can opener, which abutment stop is arranged behind the point of engagement on the can opener when viewed in the direction of movement of the can.

In an electric can opener of this type (U.S. Pat. No. 4,622,749), the cutter is first in an initial position (FIG. 19(B)) in which the can rim formed by a seam is adapted to be positioned against the can driving wheel. Actuation of an operation piece connected with the cutter will then pivot the cutter towards the cutting position until its tip abuts first the upper side of the can lid (FIG. 19(C)). The cutter thus bounds the radially inner wall of the can rim from the outside such that the cutter holds the seam in fixed position laterally on the driving wheel whereby the can is short of being coupled with the can opener.

As the operation piece is further pivoted by hand, the cutter—without pivoting further relative to the lid—continues to be biased against the lid by a spring until the operation piece actuates the electric switch causing the electric motor to rotate the driving wheel and thus also the can. In the process, the tip of the cutter automatically cuts through the lid as a result of the predetermined tool geometry and the spring-loaded pressure at which the cutter is urged against the lid. The cutter then rotates about the pivot shaft formed on the operation piece until it has its elongated hole in abutment with the pin laterally protruding from the operation piece. The cutting process which then sets in causes cutting forces to be exerted by the can lid on the cutter, which forces produce a clockwise torque on the cutter. This torque is transmitted through the pivot shaft formed on the operation piece whence it is passed to the housing of the can opener (FIG. 19(E)).

The electric switch continues to be held in its closed position by the cutting forces acting on the operation piece, as long as the can lid is cut open by the cutter as the can is being turned; however, as soon as the lid is completely severed from the can, the cutting forces on the cutter which hold the switch closed via the operation piece disappear. At the moment the lid becomes severed from the can, a leaf spring pivotally mounted on the operation piece and bearing with a low biasing force against the seam of the can exclusively for the purpose of opening the switch urges the operation piece in counterclockwise direction away from the can upwardly, whereby the operation piece opens the electric switch causing the can opener to stop operation (FIG. 19(F)).

In this known can opener, it is to be considered less advantageous that in cans of different makes a continuous propulsion and thus a uniform cutting action are not always ensured during the cutting process, although the driving wheel is driven reliably, because the force of pressure of the seam on the driving wheel cannot be adapted to the varying cutting forces. The resulting slip of the driving wheel relative to the seam causes an increased wear of the parts involved and a higher power demand of the can opener which is increased still further if at the same time the tool geometry and the dimensions of the cutter mounting structure relative to the driving wheel are chosen unfavorably. To this, the higher energy expenditure has to be added which is caused by the repeated starts of the cutting operation. This necessitates a substantially more powerful drive unit if good cutting results are desired. A more powerful motor increases, however, the manufacturing cost of the can opener. Further, removing the can from the can opener during the cutting operation is not possible or only with great effort, because the operation piece keeps the switch in the closed position due to the torque acting on the operation piece.

It is, therefore, an object of the present invention to provide a can opener which opens all commercially available cans easily and perfectly with a minimum possible amount of energy expenditure and which permits detachment of any can from the can opener at any time and in any cutting position without appreciable effort.

This object is accomplished by the invention in that a second abutment stop is provided on the can opener, that the second abutment stop is formed on the cutter, and that the second abutment stop acts upon the seam from above with the can opener in the cutting position. The second abutment stop makes it possible that the torque resulting at the cutter on account of the cutting forces, instead of bearing directly upon the housing of the can opener, acts upon the seam of the can in accordance with the invention. It is thereby achieved that the can is propelled by the driving wheel to a just sufficiently good degree.

In cans of greater tin thicknesses, higher cutting forces result; however, these can only be achieved if increased forces for propelling the can are applied.

Yet, increased force application is only possible if the second abutment stop urges the seam against the driving wheel with greater force to cause the seam to penetrate more deeply into the teeth of the driving wheel to thereby increase the frictional or positive engagement relationship between these parts. Consequently, to ensure perfect propulsion of the can, only such an amount of energy is expended at the second abutment stop by the automatic control of the force of pressure as is necessary to sever the lid from the can, that is, the energy-consuming deformation work caused by the force of pressure between the driving wheel and the seam is just sufficient to ensure sufficient frictional engagement and/or positive engagement between the driving wheel and the seam.

Because the force of pressure acts from above on the end surface of the seam, undesired transverse forces during the cutting operation are avoided which might cause jamming of the seam or the can wall between the cutter and the driving wheel. Thus, the abutment stop provided on the cutter in accordance with the invention provides a can opener requiring substantially less energy than conventional can openers, that is, an accumulator-operated can opener is capable of opening more cans within less time at the same charging capacity.

Because the second abutment stop of the invention is secured to the cutter and not to the housing of the can opener, it is possible to remove any can from the can opener with particular ease, whether upon interruption of a cutting operation or upon termination of a cutting operation, without the need, as known from the state of the art, to lever the cutter out of the can with great effort and complications using the hand holding the can opener—the other hand being required to hold the can. In accordance with the invention, it is only necessary to pivot the can about the point of engagement in the direction of rotation of the driving wheel, such that the seam of the can moves the second abutment stop away in upward direction, causing the cutter to pivot out of the can back into its initial position. This arrangement of the invention is of advantage particularly in hand-operated can openers, in addition to being advantageous if the direction of rotation of the driving wheel is towards the hand. In this event, the can is pivoted away forwardly by the hand holding the can opener so that the hand holding the can opener is not hindered.

The second abutment stop further affords the advantage that the cutting edge invariably assumes the same position with the same type of can, that is, its cutting engagement with the can lid occurs always at the same place. Accordingly, orientation of the cutter is only via the can rim so that the cutter is not drawn deeply into the can which would increase the cutting forces undesirably as a result of the then changing tool geometry including, for example, the cutting angle, and would thus entail a higher power consumption of the can opener.

To ensure that in the cutting process the cutting angle between the can lid and the cutting edge of the cutter is maintained at a predetermined value, an improvement of the invention provides for a force of pressure to act from the cutter via the second abutment stop on the seam for guiding the can during the cutting operation, the force of pressure acting on the seam ahead of the point of engagement when viewed in the direction of movement of the seam. In a simplified mechanical representation, the seam thus forms in the area of the first and second abutment stop a lever which is rotatably carried at the point of engagement of the driving wheel and keeps its balance during the cutting operation in that the first and the second abutment stop act on the seam from above while the driving wheel acts on the seam from below, and in that the sum of the moments to the left and right of the point of engagement equals zero. The points of contact of the seam with the first and second abutment stop and the driving wheel are so arranged that in the cutting position the lid forms the cutting angle with the cutting edge. Accordingly, the second abutment stop also serves the purpose of ensuring that the cutting edge extends at an accurately predetermined angle to the can lid in order that only the minimum cutting action necessary for severing the lid from the can can be maintained.

Because the second abutment stop acts on the seam ahead of the point of engagement, it is possible to choose the distance between the second abutment stop and the point of engagement such that, in spite of a relatively low force of pressure acting on the second abutment stop, sufficient frictional/positive engagement for safe movement of the can exists already at the point of engagement. The propulsive force of the driving wheel is not appreciably changed by the second abutment stop because its abutting forces are low as a result of the cutter geometry chosen.

It is an advantage that the force of pressure, when viewed in the direction of movement of the seam, acts on the seam ahead of the cutting area. As a result, the widely spaced abutment stops provide the can with a particularly good guide relative to the point of engagement during cutting. In accordance with the invention, the seam of a can can be urged against the driving wheel sufficiently firmly solely by the drive of the can opener and without additional manual effort if the force of pressure is formed by a torque produced at the cutter during the cutting operation as a result of the cutting forces and dimensions of the cutter. However, it is also possible for the force of pressure to be produced merely by a torque applied to the cutter by additional manual action, which torque is initiated, for example, by the control element operating the cutter and energizing the electric drive.

It is, however, also possible that the force of pressure is provided by a torque resulting at the cutter during the cutting operation for one thing and by a second torque acting on the cutter manually for another thing. This last-mentioned operating method has the advantage of ensuring perfect abutment of the can between the two abutment stops and the driving wheel even if the lid is not cut open. Another advantage of this operating method is that it enables the control element to be acted upon manually by an additional force in the event that the force of pressure resulting at the second abutment stop on account of the cutting forces should not suffice for a uniform movement of the can The force of pressure transferable by hand from the control element to the second abutment stop is limited by a spring inserted in the path between the control element and the cutter in order that the piercing action is accomplished by automatic piercing resulting from the tool and bearing geometry predetermined by the cutter, rather than by the application of a very high manual force.

The second abutment stop on the cutter becomes particularly simple if it is formed by a piece of sheet metal laterally protruding from the cutter on the side close to the driving wheel This second abutment stop may be provided on the cutter for example by deforming the cutter, by welding, screw fastening or similar fastening means known in the art of mechanical engineering. The possibility exists also to mold the second cutter integrally with the abutment stop, for example, as a die-casting. To permit simple operation of the cutter from the front by hand, the second abutment stop advantageously protrudes laterally from either side of the cutter.

To restrict the force of pressure acting from the second abutment stop on the seam to nearly a single point, a projection extending in the direction of the seam is formed on the second abutment stop. The projection may be configured as a bead, groove, knob, etc.

To ensure that during the cutting operation a force of pressure acting from the second abutment stop on the rim of the can is obtained which results exclusively from the cutting forces acting on the cutter, in an improvement of the invention the perpendicular drawn on the cutting edge through the cutting area lies at a distance b ahead of the center of the pivot shaft of the cutter, when viewed in the direction of movement of the seam, and the relationship between the distance b, the vertical distance c measured from the center of the pivot shaft of the cutter to the cutting edge, and the cutting angle a which is formed by the cutting edge and the can lid to be severed, is as follows:

$$b/c \cot a > 1.$$

In a preferred embodiment of the invention, the center of the pivot shaft of the cutter, when viewed in the direction of movement of the seam, is at a distance x behind the area of cutting engagement, such that the resultant force resulting during the cutting operation in the cutting area of the cutter from the cutting forces acting thereon extends through the pivot shaft of the cutter. This has the advantage that the control element for pivoting the cutter into the cutting position is substantially free of forces also during the cutting operation, which increases the efficiency of the can opener. It is to be understood that in this case the operator is additionally required to exert a force of pressure acting from the second abutment stop on the seam to ensure safe movement of the can.

The position of the cutting edge in relation to the pivot shaft of the cutter as disclosed in the invention further has the advantage that the cutter is held in the cutting position not by positive engagement but only by the frictional forces occurring at the cutting edge during the cutting operation. If the cutting operation is interrupted, these frictional forces can be overcome easily, enabling the cutter to be pivoted back into its starting position and the can opener to be detached from the can Thus, it is also possible to interrupt cutting before the lid is completely severed, which is desirable in many cases.

To cause the can to experience during cutting a counterclockwise, leftward moment extending in the pivot plane of the cutter, an improvement of the invention provides for the cutting area to be ahead of the point of engagement between the driving wheel and the seam, when viewed in the direction of movement of the can and with the cutter in the cutting position.

In order to avoid that the cutting edge of the cutter engages with its piercing tip into the still uncut area of the can lid when the cutting process is interrupted and the cutter is subsequently pivoted out of the lid, the invention further provides for the distance b to correspond to at least half the distance between the cutting area and the piercing tip. As a result of this arrangement, the piercing tip thus moves only in the slit of the can lid already cut by the cutter when the cutter is pivoted out, enabling the cutter to glide freely out of the can which is thus readily detachable from the can opener. Consequently, this arrangement and the elastic link between the control element and the cutter permit interruption of the cutting operation at any time and without any effort also before the lid is completely severed, which is desirable in many cases.

In a further improvement of the invention, it is suggested to arrange the second abutment stop on the cutter in such a manner that in the cutting position the piercing tip and the center of the driving wheel lie on a straight line extending substantially normal to the upper edge of the seam of the can. It has shown that this arrangement further reduces the cutting drag resulting during the cutting operation.

Further it has been found that with the can opener of the invention an advantageously low driving torque on the driving wheel and a favorable cutting action are achievable if the setting angle a of the cutting edge relative to the can lid to be severed does not exceed 30°, lying in particular in a range of between 15° and 30°. Particularly low cutting forces have resulted at a setting angle of 27.5°. The cutting results are still further favored in particular if in the direction of movement of the seam the distance between the centers of the driving wheel and the pivot shaft of the cutter is in the range of between 5 mm and 10 mm, preferably 6.5 mm, and if the distance normal to the direction of movement is in the range of between 15 mm and 30 mm, preferably 24 mm.

In accordance with the invention, an advantageously low cutting force is further achieved in that the cutting edge of the cutter has an adjacent guiding surface on its rear side and an adjacent first parting surface on its front side and that both surfaces enclose an angle d of between 70° and 85°. The relatively large angle d ensures that the cutter does not become wedged in the slit of the can lid during cutting but rather tends to move upwardly out of the slit. Because the cutting area lies ahead of the point of engagement when viewed in the direction of movement of the seam while at the same time the cutter is provided with a parting surface, the can is guided in a manner preventing it from oscillating about the point of engagement. This provision, too, reduces the energy demand of the can opener. On account of the relatively large angle, the first parting surface receives the major part of the cutting energy right at the beginning of the cutting operation, with the cutter rather tearing or ripping up the lid in the cutting area than cutting it. Therefore, the cutting edge is not sharp which eliminates the possibility of personal injury.

The second parting surface whose angle is relatively small by comparison with the angle of the first parting surface is necessary in order that in the second phase of the parting operation it is predominantly only the material on either side of the cutting area that has to be urged away with as little expenditure of energy as possible.

In accordance with the invention, an advantageous cutter geometry is further obtained in that the first and the second parting surface extend towards the piercing tip of the cutter. Accordingly, the two parting surfaces taper from the entry side of the can towards the piercing tip of the cutting edge, thereby facilitating the piercing operation and also the pivotal movement of the cutter back into its initial position.

To ensure maximum life of the piercing tip, in a further proposal of the invention the piercing tip has an adjacent flank when viewed in the direction of movement of the can, which flank encloses an obtuse angle with the cutting edge.

A good guiding of the can rim, including thus also the can, relative to the can opener is advantageously ensured in that in the cutting position the end surfaces laterally bounding the cutting edge and the flank have their edge areas in abutment with the inner wall of the seam. By this means, the can is prevented from oscillating about the point of engagement during the cutting operation when viewed in top plan view of the can, in order that a clean cut nearly parallel to the seam is accomplished. In order to obtain a maximum possible guiding of the end surfaces relative to the can inner wall or the inside of the seam, the end surfaces extend substantially normal to the upper edge of the seam. In conventional round cans, but also in quadrangular cans, a vertical distance y of between 6 mm and 10 mm, preferably of 8 mm, between the end surfaces has proved to be advantageous.

In order to keep the friction ratios between the opposed end surfaces provided on the cutter and the can inner wall or the lid and the inner edge of the seam as low as possible during the cutting operation and to avoid jamming, the lateral ends of the end surfaces are radiused or chamfered. This reduces further the energy expenditure during cutting.

To favour the automatic piercing action of the cutter into the can lid, it is further provided to arrange the piercing tip, in cutting position and when viewed in the direction of movement of the can rim, rearwardly of the perpendicular extending through the center of the pivot shaft of the cutter and drawn on the cutting edge.

To minimize the propulsive resistance between the driving wheel and the seam, a further improvement of the invention provides radially outwardly extending teeth on the periphery of the driving wheel, which teeth extend in saw-tooth fashion. The greater the angle between two tooth flanks, the less the teeth engage the underside of the seam and the lower the deformation work to be performed. The deformation work performed as the saw-teeth dig into the seam can be further reduced if the teeth are provided with flanks of different lengths, the essential point being that the longer and flatter tooth flank is arranged forwardly of the shorter and steeper tooth flank when viewed in the direction of rotation of the driving wheel. The shorter tooth flank provides for an improved positive and/or frictional engagement between the driving wheel and the seam, while the longer tooth flank permits an improved disengagement of the respective tooth from the recess formed in the seam by the teeth. In this arrangement, it is particularly advantageous if the diameter of the driving wheel is chosen as large as possible to enable as many teeth as possible to engage the underside of the seam. Using a driving wheel with a diameter of between 10 mm and 20 mm, preferably 15 mm, engagement is already good, without the force of pressure of the second abutment stop being excessively great.

The present invention will be described in more detail in the following with reference to the accompanying drawings illustrating an embodiment thereof. In the drawings, FIG. 1 is a side view showing the area of an electrically operated can opener comprising the cutting device, including a fragment of a partly sectioned rim area of a can;

To avoid repetitions, like parts have been assigned like reference numerals throughout the FIGS. 1 to 4.

Figure 1:
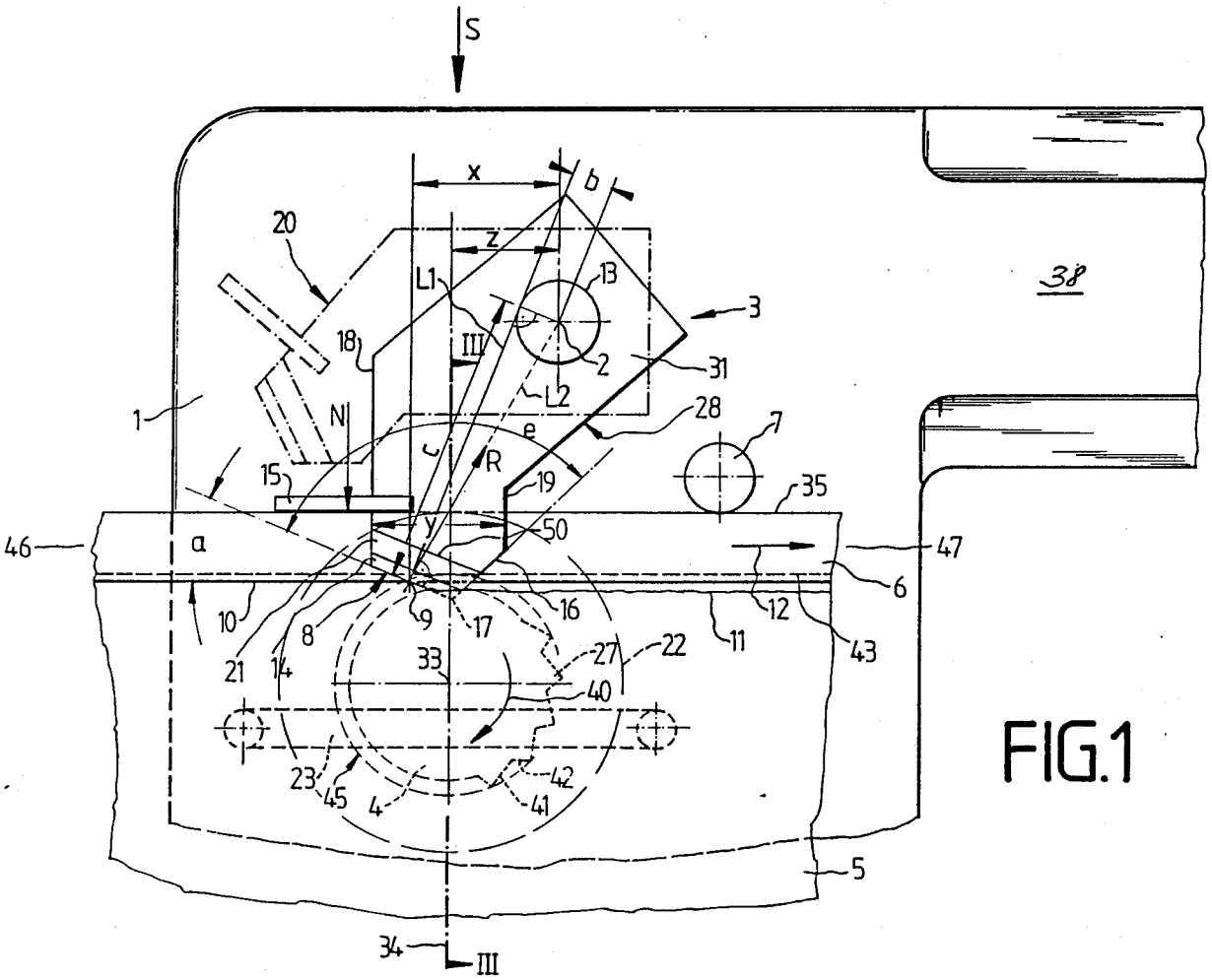
Figure 4:
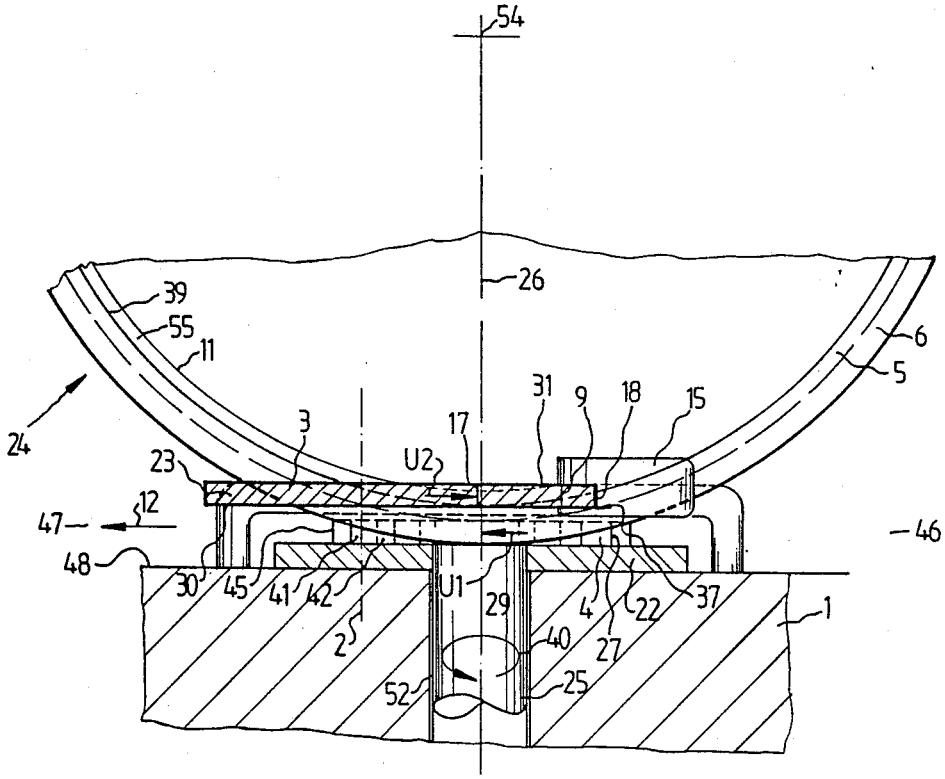
FIG. 4 is a top plan view of the can opener, taken as indicated by the arrowed line S of FIG. 1 in the area of the cutter arrangement, yet turned through 180°.

The can opener shown in FIG. 1 is comprised of a housing 1 on which are mounted in relatively spaced arrangement a pivot shaft 13 of a cutter 3 pivotable from an initial position 20 (shown in dot-and-dash lines) into a cutting position 28, and a driving wheel 4. The driving wheel 4 is driven in the direction of rotation 40 by a gearing and an electric motor not shown in the drawing. In FIG. 4, there is provided between the cutter 3 and the driving wheel 4 a cylindrical wall portion 5 of a can 24 having the lower edge 43 of its upper seam 6 resting on the periphery 45 of the driving wheel 4 while the upper edge 35 of the seam 6 takes support upon a first abutment stop 7 configured as a guide pin which is secured to the housing 1 rearwardly of the driving wheel 4, that is, on the exit side 47 when viewed in the direction of movement 12 of the can 24. In FIG. 4, this guide pin 7 is not shown for reasons of clarity of the representation shown in this Figure. The direction of movement 12 of the can 24 is understood to mean the direction in which the portion of the seam 6 abutting the cutter 3 moves.

In FIGS. 1 to 4, the cutter 3 is shown in its cutting position 28 in which its cutting edge 8 severs the lid 10 in the cutting area 9 in the immediate vicinity of the seam 6. The slightly downwardly bent rim of the severed lid 10 is identified by reference numeral 11. In the cutting position 28 shown, the cutting edge 8 has a setting angle "a" of 27.5°. The setting or cutting angle "a" is formed by the cutting edge 8 and the horizontal illustrated in FIGS. 1 and 2 which forms at the same time the lid 10.

In accordance with FIG. 1, the exact pivot position of the cutter 3 in its cutting position 28 is determined by a second abutment stop 15 configured as a stop plate which is secured to the cutter 3 on its entrance side 46 and which, with the cutter in the cutting position 28, rests on the upper edge 35 of the seam 6. This enables the position of the cutter 3 to be readily adapted to different heights of the seam 6.

Figure 3:
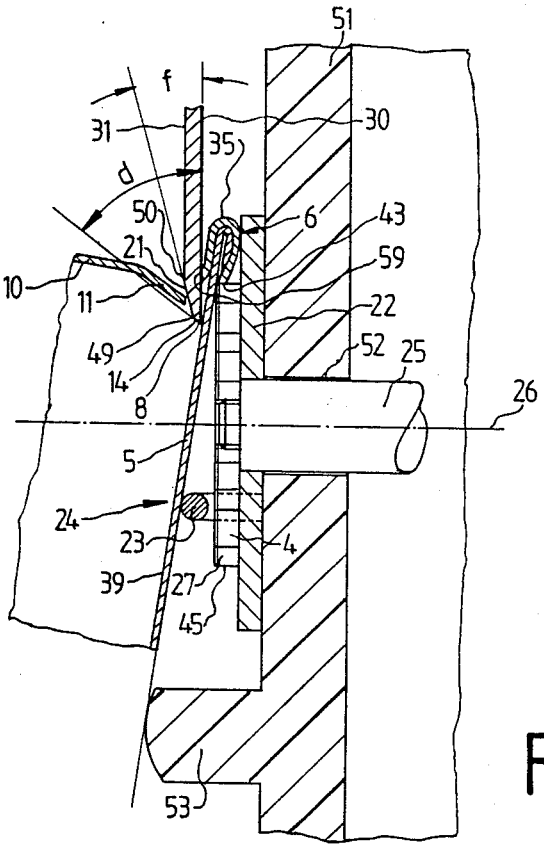
FIG. 3 is a partial cross sectional view of the housing of the can opener, taken along the line III—III longitudinally of the axis of rotation of the driving wheel.

In FIGS. 1 and 3, a first parting surface 14 is adjacent to the cutting edge 8 in upward direction, which parting surface encloses the angle "d" with the guiding surface 30 provided on the rear side of the cutter 3 and extending substantially parallel to the wall surface 48 of the housing 1. A second parting surface 21 enclosing the angle "f" with the guiding surface 30 is adjacent to the first parting surface 14 further upwardly when viewing the drawing. In the cutting position 28 of FIG. 3, the guiding surface 30 rests against the inside 39 of the wall 5 and against the radially outer cutting area 59 of the lid 10.

Figure 2:
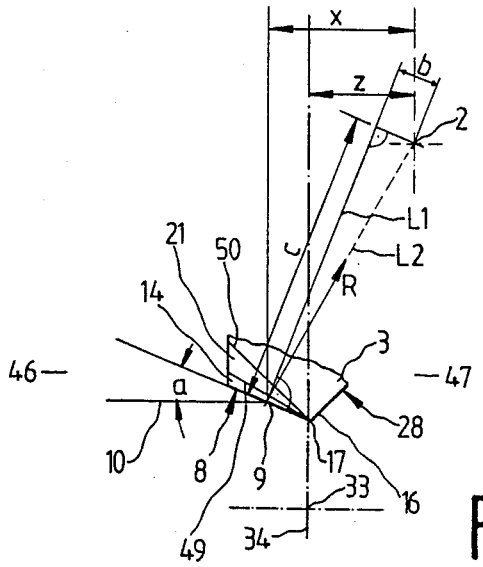
FIG. 2 is a partial view of the cutter in the area of the cutting edge, including the geometrical representation of the cutting device.

In FIG. 1, the edges 49, 50 which are formed at the transitions from the first parting surface 14 to the second parting surface 21 and from the second parting surface 21 to the front side 31 of the cutter 3, extend parallel to the cutting edge 8. In FIG. 2, these edges 49, 50, instead of extending parallel to the cutting edge 8, approach the piercing tip 17, intersecting it. The piercing tip 17 forms the point at the end of the cutting edge 8 nearest to the center 33 of the driving wheel 4.

In accordance with FIG. 3, the driving wheel 4 protrudes from the wall surface 48, taking support upon the wall surface 48 via a washer 22. The washer 22 is mounted on the drive shaft 25 driving the driving wheel 4. The drive shaft 25 extends through the housing wall 51 in the bore 52 and is connected to the drive motor via a gearing not shown in the drawing. The driving wheel 4 is connected to the drive shaft 25 in a non-rotating relationship thereto.

A bracket 23 secured to the housing 1 projects from the wall surface 48 in a manner embracing the driving wheel 4. The U-shaped bracket 23 serves to support cans 24 of particularly low height as, for example, sardine cans. In FIG. 3, a ledge 53 is provided on the wall surface 48 below the bracket 23, which ledge serves to support tall cans 24 In the cutting position 28, the bracket 23 and the ledge 53 serve to guide a can 24 towards the front side 31 of the cutter 3 in such an inclined position that during the cutting operation the guiding surface 30 approaches the inner surface 60 of the seam 6 as closely as possible, without being hindered by the seam. This makes it further possible to sever the lid 10 directly at the seam 6.

Projecting from the periphery 45 of the driving wheel 4 are teeth 27 in saw-tooth form whereof the forward tooth flank 41, when viewed in the direction of rotation 40, is longer than the adjoining tooth flank 42.

In FIG. 1, there is adjacent to the cutting edge 8 a flank 16 extending towards the exit side 48, which flank encloses an angle "e" with the cutting edge 8. On the entrance side 46, the cutting 8 edge is bounded by the end surface 18 which extends vertically upwardly when viewing the drawing. Adjacent to the flank 16 on the exit side 48 is the end surface 19 which extends parallel to the end surface 18. The two end surfaces 18, 19 extend at a relative distance "y" which is dimensioned such that the inside 39 of the wall 5 is in abutment with the portions 36, 37 configured as corners. The portions 36, 37 are radiused which, however, is not shown in the drawing. The greater the dimension "y", the more evenly and concentrically rotates a cylindrical can 24 about its center 54, that is, a slit 55 extending almost parallel to the the seam 6 is obtained, as shown in FIG. 4. If, however, "y" is overdimensioned, the cutting area 9 will move progressively closer to the center 54 of the can 24, causing also the slit 55 to extend at a greater distance parallel to the seam 6. This again has the disadvantage that the edge 49 projects from the wall 5 which might cause injuries.

As best shown in FIG. 4, the cutting area 9 is to the left of the axis of rotation 26 of the driving wheel 4, while the piercing tip 17 extends approximately vertically above the axis of rotation 26 when in cutting position 28 (see FIG. 1). As becomes further apparent from this Figure, the distance between the end surface 18 and the axis of rotation 26 is smaller than the distance between the end surface 19 and the axis of rotation 26. This arrangement has been chosen in order that during the cutting operation, the circumferential force U1 which is transmitted at the point of engagement 29 from the teeth 27 to the lower edge 43 of the radially outer seam 6 (FIG. 3) and which in FIG. 4 exerts a counterclockwise torque on the can 24, is counteracted by a circumferential force U2 which is exerted by the cutting area 9 on the lid 10 and produces a torque acting clockwise on the can 24. It is avoided by these counterbalanced torques that the inside 39 of the wall 5 of the can 24 presses against the end surfaces 18, 19 of the cutter 3 with only a very small force. Friction in these areas is thereby reduced which increases the efficiency of the can opener on the one hand while preventing the can 24 from oscillating about the point of engagement 29 on the other hand.

As best seen in FIG. 2, the cutting area 9 is provided on the cutter 3 to the left of the vertical straight line 34 extending through the center 33 of the driving wheel 4. The perpendicular L1 drawn on the cutting edge 8 and intersecting the cutting area 9 extends at a distance "b" forward of the center 2 of the pivot shaft 13 of the cutter 3. The cutting force acting vertically on the cutting edge 8 in the cutting area 9 thereby tends to pivot the cutter 3 in clockwise direction. This tendency is counteracted by the frictional forces acting on the cutting edge 8, so that in practice the cutter 3 is moved counterclockwise during the cutting operation, that is, it is moved into the can 24. However, it is also possible to configure the tool geometry of the can opener such that the resultant "R" of all forces extends approximately through the pivot center 2. In this event, the cutter 3 is largely free of torques produced by the cutting operation and can therefore be held in the cutting position 28 shown with little effort by means of a counterclockwise torque produced by a control element, not shown in the drawing, which acts on the pivot center 2. The control element may be, for example, a lever mounted on the housing 1, which lever is operated by hand and is used for pivoting the cutter 3 into the cutting position 28 in addition to actuating a switch, not shown in the drawing, for energizing the electric motor and thus the can opener.

In FIG. 1, a handle 38 configured as a U-shaped bracket and facilitating the handling of the can opener is provided on the housing 1 on the exit side 47.

The mode of operation of the can opener of the invention is as follows:

First, a can 24 is positioned on the periphery 45 of the driving wheel 4 with its lower edge 43 which is formed on the seam 6 at its radially outer circumference (FIG. 3). The seam 6 is then held captive between the cutter 3 and the driving wheel 4 such that the can 24 is no longer detachable from the can opener.

A counterclockwise torque acting on the cutter 3 causes the piercing tip 17 to be pressed against the upper side of the lid 10 under bias. At this moment, the driving wheel 4 starts turning in the direction of rotation 40, thereby turning the can 24 in the direction of movement 12. Due to the larger setting angle "a" of the cutting edge 8 and the displaced point of action of the forces on the piercing tip 17, the piercing operation occurs automatically, therefore requiring no appreciable application of force by the control element.

After piercing the lid 10, the cutter 3 penetrates into the lid 10 as a result of the cutting pressure and the cutting friction at its cutting edge 8 until the second abutment stop 15 is in abutment with the upper edge 35 of the seam 6. The predetermined tool geometry causes a resultant force "R" to act on the cutting area 9, which force exerts a counterclockwise torque on the cutter 3. This torque bears against the upper edge 35 of the seam 6 via the second abutment stop 15 in the form of the force "N". The can 24 thereby experiences a leftward, counterclockwise torque according to FIG. 1 which in turn bears against the driving wheel 4 and the first abutment stop 7 accordingly, the thicker the sheet material of the lid 10, the greater the force N and the more the seam 6 is pressed against the driving wheel 4. This self-reinforcement ensures at all times reliable propulsion of the can 24 and thus a continuous cutting operation without necessitating additional operator effort. Even in the event of different distances between the upper edge 35 of the seam 6 and the surface of the lid 10, the cutter 3 adjusts itself always automatically, thereby preventing the setting angle "a" from assuming impermissible values. During the cutting operation, the seam 6 is guided in the circumferential direction of the can 24 by the end surfaces 18, 19 of the cutter 3 which extend normal to the direction of movement and are on the side close to the seam 6.

If it is desired to interrupt the cutting process although the lid 10 is not yet completely severed from the can 24, this can be done without problems and effort. As soon as the driving wheel 4 has stopped moving because the drive motor is deenergized, it is only necessary to swing the can 24 leftwards about the point of engagement 29 (FIG. 1) in order for the upper edge 35 of the seam 6 to press the second abutment stop 15 upwardly according to FIG. 1 of the drawing. In the process, the cutter will become disengaged from the slit 55 and return to its initial position 20. Jamming of the cutter 3 in the slit 55 is not possible because the cutting edge 8, in the disengagement movement of the cutter 3, detaches itself from the cutting area 9 on the lid 10. The movement of the cutter 3 back into the initial position 20 is thus only decelerated by the frictional engagement between the lid 10 and the seam 6 which, however, can be easily overcome as a result of the advantageous first and second parting surfaces 14, 21 on the cutter 3. Nor does the piercing tip 17 obstruct the outward pivotal movement of the cutter 3 because it does not contact the uncut area of the lid 10 either.

If, for example, the lid 10 is completely severed from the can 24, the cutter 3 is pivotable out of the can 24 in the same manner as described in the foregoing.

I claim:

1. A can opener for severing the lid from a can, including support structure, a drive unit, a driving wheel connected in driven relation to said drive unit and rotatably mounted on said support structure, said driving wheel, for the purpose of propelling the can, being adapted to engage from outside under the seam of the can at a point of engagement, a pivot shaft on said support structure at a predetermined distance from said driving wheel, a cutter mounted on said pivot shaft and pivotable from an initial position above the lid of a can into a cutting position, said cutter having a piercing tip and an adjoining straight line cutting edge with a cutting area which is in engagement with the lid when said cutter is in said cutting position, a first abutment stop fixed on said support structure for guiding the can relative to said cutting edge, said first abutment stop being arranged rearwardly of said point of engagement on the can opener when viewed in the direction of movement of the can by said driving wheel, and a second abutment stop on said cutter, said second abutment stop acting upon the seam of the can from above the said cutter in said cutting position, a perpendicular drawn on said straight line cutting edge through said area of engagement between said cutting edge and said lid lying ahead of the center of said pivot shaft of said cutter, when viewed in the direction of movement of the can by said driving wheel, a distance that corresponds to at least half the distance between said cutting area and said piercing tip.

2. A can opener as claimed in claim 1, characterized in that the force of pressure (N), when viewed in the direction of movement of the seam, acts on the seam ahead of said cutting area.

3. A can opener as claimed in claim 1 wherein the force of pressure (N) is produced by a torque applied to said cutter by hand.

4. A can opener as claimed in claim 1 wherein the force (N) is provided by a torque resulting at said cutter during the cutting operation for one thing and by a torque acting on said cutter by hand for another thing.

5. A can opener for severing the lid from a can, including support structure, drive structure, a driving wheel connected in driven relation to said drive structure and rotatably mounted on said support structure, said driving wheel, for the purpose of propelling the can, being adapted to engage from outside under the seam of the can at a point of engagement, a pivot shaft on said support structure at a predetermined distance from said driving wheel, a cutter mounted on said pivot shaft and pivotable from an initial position above the lid of a can into a cutting position, said cutter having a piercing tip and an adjoining cutting edge with a cutting area which is in engagement with the lid when said cutter is in said cutting position, a first abutment stop fixed on said support structure for guiding the can relative to said cutting edge, said first abutment stop being arranged rearwardly of said point of engagement on the can opener when viewed in the direction of movement of the can by said driving wheel, and a second abutment stop on said cutter, said second abutment stop acting upon the seam of the can from above with said cutter in said cutting position, said second abutment stop being secured to said cutter immediately adjacent said cutting edge and laterally protruding from said cutter on the side close to said driving wheel.

6. A can opener as claimed in claim 5 wherein said second abutment stop protrudes laterally from either side of said cutter.

7. A can opener as claimed in claim 5 wherein said second abutment stop is of sheet metal and includes a projection extending in the direction of the seam.

8. A can opener for severing the lid from a can, including a support structure, drive structure, a driving wheel connected in driven relation to said drive structure and rotatably mounted on said support structure, said driving wheel, for the purpose of propelling the can, being adapted to engage from outside under the seam of the can at a point of engagement, a pivot shaft on said support structure at a predetermined distance from said driving wheel, a cutter mounted on said pivot shaft and pivotable from an initial position above the lid of a can into a cutting position, said cutter having a piercing tip and an adjoining cutting edge with a cutting area which is in engagement with the lid when said cutter is in said cutting position, a first abutment stop fixed on said support structure for guiding the can relative to said cutting edge, said first abutment stop being arranged rearwardly of said point of engagement on the can opener when viewed in the direction of movement of the can by said driving wheel, and a second abutment stop on said cutter, said second abutment stop acting upon the seam of the can from above with said cutter in said cutting position, the perpendicular drawn on said cutting edge through said cutting area lies at a distance (b) ahead of the center of said pivot shaft (13) of said cutter, when viewed in the direction of movement of the can by said driving wheel, and that the relationship between said distance (b), the vertical distance (c) measured from the center of said pivot shaft of said cutter to said cutting edge, and the cutting angle (a) which is formed by said cutting edge and the can lid to be severed, is as follows:

$$b/c \cdot \cot a > 1$$

9. A can opener as claimed in claim 8 wherein the center of said pivot shaft of said cutter, when viewed in the direction of movement of the seam, is at a distance (x) behind the area of cutting engagement, such that the resultant force (R) resulting during the cutting operation in the cutting area of said cutter from the cutting forces acting thereon extends through said pivot shaft of said cutter.

10. A can opener as claimed in claim 1 wherein in the cutting position of said cutter, said cutting area, when viewed in the direction of movement of the can, lies ahead of the point of engagement between said driving wheel and the seam.

11. A can opener as claimed in claim 8, characterized in that the distance (b) corresponds to at least half the distance between said cutting area (9) and said piercing tip (17).

12. A can opener as claimed in claim 8 wherein said second abutment stop is arranged on said cutter in such a manner that in said cutting position said piercing tip and the center of said driving wheel lie on a straight line extending substantially normal to the upper edge of the seam of the can.

13. A can opener as claimed in claim 8 wherein said cutting edge, with said second abutment stop abutting the seam, encloses with the can lid to be severed a setting angle (a) which does not exceed 30°, being in particular between 15° and 30°.

14. A can opener as claimed in claim 13 wherein said setting angle (a) is 27.5°.

15. A can opener as claimed in claim 1 or 8 wherein in the direction of movement of the seam, the distance between the respective centers of said driving wheel and said pivot shaft of said cutter is in the range of between 5 mm and 10 mm, preferably 6.5 mm, and that the distance normal to the direction of movement is in the range of 24 mm.

16. A can opener as claimed in claim 8 wherein said cutting edge of said cutter has an adjacent guiding surface on its rear side and an adjacent first parting surface on its front side, and that both surfaces enclose an angle (d) which is between 70° and 85°.

17. A can opener as claimed in claim 16 wherein adjacent to said first parting surface is a second parting surface which encloses with said guiding surface an angle (f) which is smaller than angle (d).

18. A can opener as claimed in claim 17 wherein said angle (d) is in the range of between 40° and 65°.

19. A can opener as claimed in claim 17, wherein said first and second parting surfaces extend towards said piercing tip of said cutter.

20. A can opener as claimed in claim 1 wherein, when viewed in the direction of movement of the can, said piercing tip has an adjacent flank which encloses an obtuse angle (e) with said cutting edge.

21. A can opener as claimed in claim 20 wherein said cutter has end surfaces that laterally bound said cutting edge and in said cutting position, said end surfaces and said flank have their edge areas in abutment with the inner wall of the seam.

22. A can opener as claimed in claim 21 wherein said end surfaces, when said cutter is in said cutting position extend substantially normal to the upper edge of the seam.

23. A can opener as claimed in claim 22 wherein the distance (y) between said end surfaces is between 6 mm and 10 mm, approximately, preferably 8 mm.

24. A can opener as claimed in claim 21 wherein the lateral ends of said end surfaces are formed by radiused or chamfered portions.

25. A can opener as claimed in claim 24 wherein, in said cutting position and when viewed in the direction of movement of the seam, said piercing tip lies rearwardly of the perpendicular (L2) extending through the center of said pivot shaft of said cutter and drawn on said cutting edge.

26. A can opener as claimed in claim 1 or claim 8 wherein said driving wheel includes radially outwardly extending teeth on its periphery, said teeth extending in saw-tooth fashion.

27. A can opener as claimed in claim 26 wherein said teeth are provided with flanks of different lengths, with the longer tooth flank being arranged forwardly of the shorter tooth flank of a tooth when viewed in the direction of rotation of said driving wheel.

28. A can opener as claimed in claim 26 or claim 27 wherein the diameter of the driving wheel is between 10 mm and 20 mm, preferably 15 mm.

* * * * *